United States Patent [19]

Heitmann

[11] Patent Number: 4,610,260

[45] **Date of Patent: * Sep. 9, 1986**

[54] APPARATUS FOR FORMING A TOBACCO STREAM

[75] Inventor: Uwe Heitmann, Hamburg, Fed. Rep. of Germany

[73] Assignee: Hauni-Werke Körber & Co. KG., Hamburg, Fed. Rep. of Germany

[ * ] Notice: The portion of the term of this patent subsequent to Jan. 14, 2003 has been disclaimed.

[21] Appl. No.: 557,641

[22] Filed: Dec. 2, 1983

[30] Foreign Application Priority Data

Dec. 2, 1982 [DE] Fed. Rep. of Germany ..... 3244533

[51] Int. Cl.[4] ..... A24C 5/18; A24C 5/39

[52] U.S. Cl. ..... 131/84.3; 131/108; 131/109.2; 131/110

[58] Field of Search ..... 131/84 B, 108, 109 R, 131/109 B, 109 AB, 110, 66 R

[56] References Cited

U.S. PATENT DOCUMENTS 4,175,570 11/1979 Heitmann ..... 131/84 B 4,185,644 1/1980 Heitmann et al. ..... 131/109 R 4,235,248 11/1980 Schumacher ..... 131/108

4,373,538 2/1983 Steiniger ..... 131/109 R 4,463,768 8/1984 Quarella ..... 131/84 B 4,484,589 11/1984 Steiniger et al. ..... 131/110

*Primary Examiner*—Richard J. Apley

*Assistant Examiner*—H. Macey

*Attorney, Agent, or Firm*—Peter K. Kontler

[57] ABSTRACT

The distributor of a cigarette rod making machine has an air-permeable tobacco transporting conveyor adjacent to a channel which is bounded by two spaced apart sidewalls and receives a mixture of tobacco particles and compressed air. The quantity of air entering the channel exceeds the quantity which can be evacuated through the air-permeable conveyor. Therefore, at least one of the sidewalls has a recessed air-permeable portion adjacent to an external suction chamber to draw the surplus of air from the channel without adversely influencing the trajectories of tobacco particles which are propelled toward the conveyor to form thereon a growing homogeneous tobacco stream.

20 Claims, 13 Drawing Figures

Fig.2
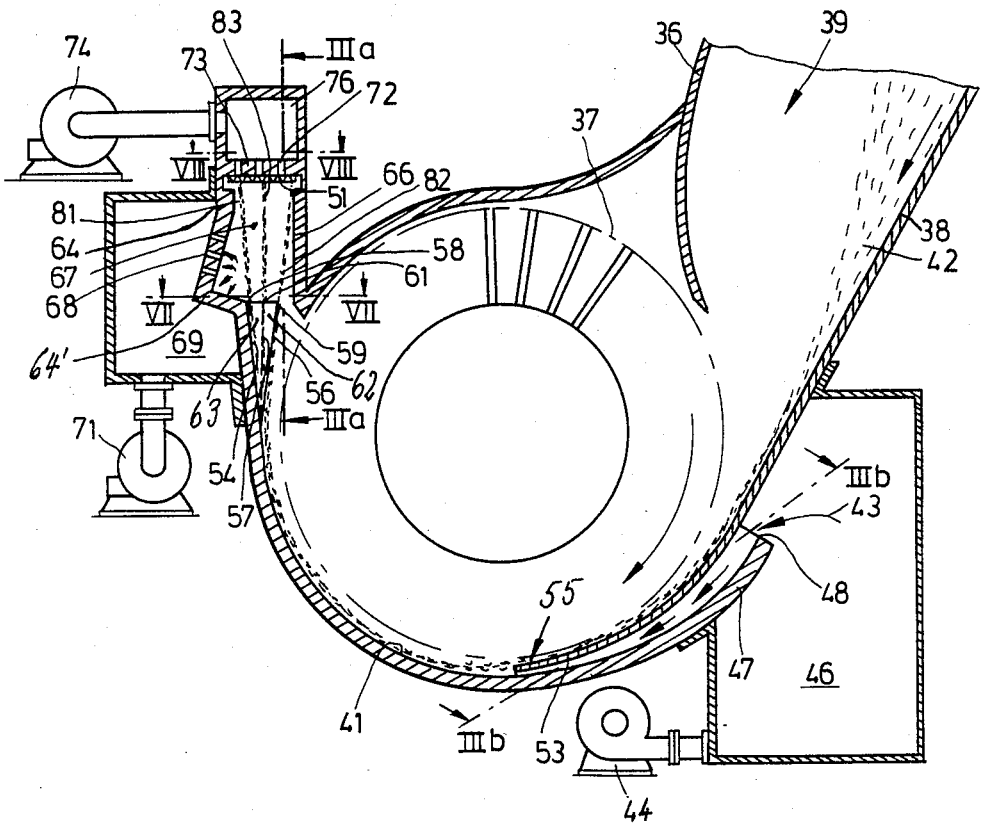
Fig.3a
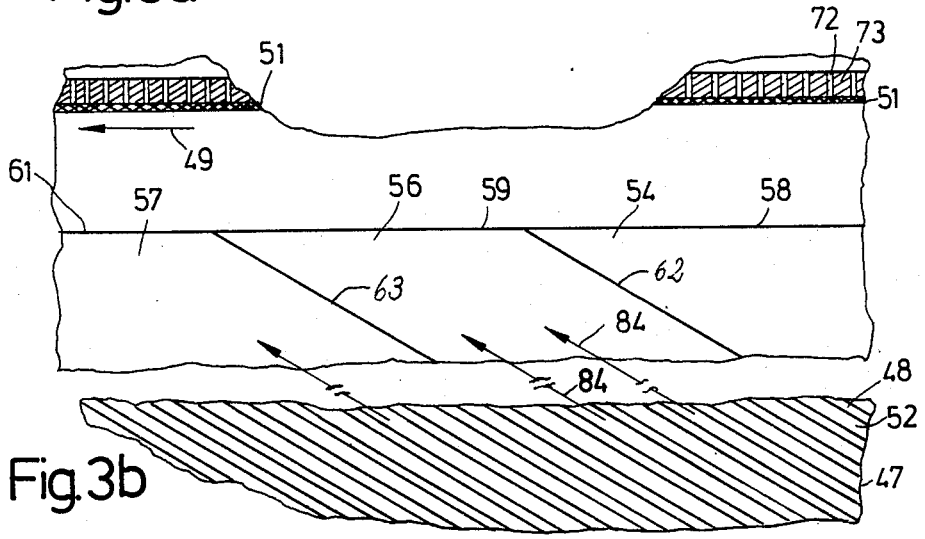
Fig.3b

Fig.4
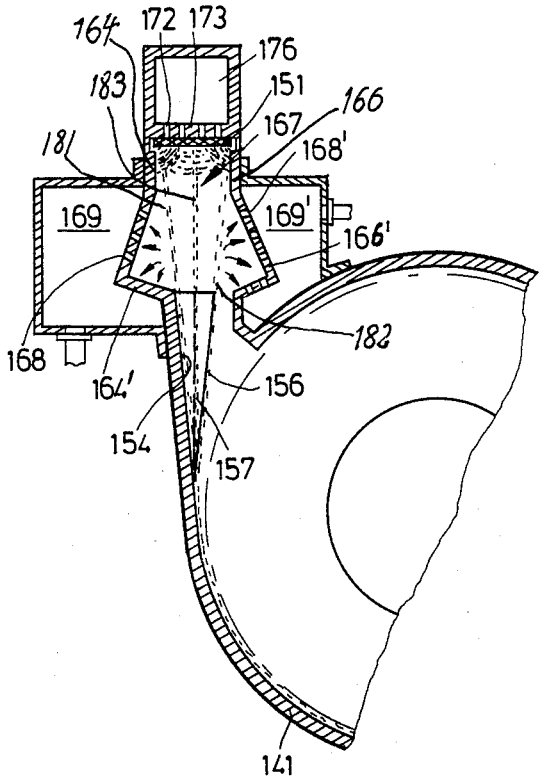
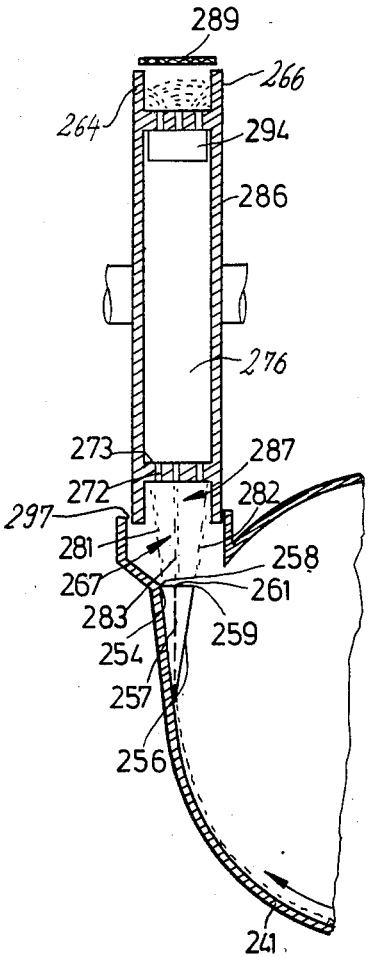
Fig.6

APPARATUS FOR FORMING A TOBACCO STREAM

CROSS-REFERENCE TO RELATED CASES

The apparatus which is disclosed in the present application is identical with those disclosed in the commonly owned copending application Ser. No. 557,732 filed Dec. 2, 1983, now U.S. Pat. No. 4,564,027 by Uwe Heitmann and in the commonly owned copending application Ser. No. 557,735 filed Dec. 2, 1983, now U.S. Pat. No. 4,564,026 by Gunter Wahle et al. Furthermore, the apparatus of the present invention is in part similar to the apparatus disclosed in the commonly owned copending application Ser. No. 557,733 filed Dec. 2, 1983 by Güunter Wahle et al. and in the commonly owned copending application Ser. No. 392,775 filed June 28, 1982 by Guido Quarella, now U.S. Pat. No. 4,463,768.

BACKGROUND OF THE INVENTION

The present invention relates to apparatus for forming a continuous tobacco stream, particularly for forming a stream which can be converted into a filler that is ready for draping into a web of cigarette paper or the like so as to constitute with the web a continuous rod which is thereupon subdivided into rod-shaped smokers' articles of unit length or multiple unit length. More particularly, the invention relates to improvements in distributors which can be used in cigarette rod making and analogous machines to convert a mass of tobacco shreds and/or otherwise configurated tobacco particles into a continuous stream which is ready for draping or is ready to be advanced into the range of one or more trimming or equalizing devices.

It is known to form a continuous tobacco stream in an elongated tobacco channel which is defined by two spaced-apart sidewalls and an endless air-permeable tobacco transporting conveyor. One side of the conveyor faces the channel and its other side is adjacent to a suction generating device serving to attract tobacco particles to the one side. The channel receives particles of tobacco in one or more streams of compressed air which are directed toward the one side of the conveyor and serve as carriers of the particles across the channel and into actual contact with the conveyor whereon the particles are retained by suction.

The forming of a tobacco stream in an apparatus of the above outlined character normally takes place by utilizing substantial quantities of compressed air some of which is used to transport tobacco particles and the remainder of which is used to classify the tobacco, i.e., to segregate satisfactory particles from unacceptable particles before the satisfactory particles are permitted to enter the channel at the one side of the tobacco transporting conveyor. In many instances, the quantity of air which is admitted into the channel exceeds the quantity which can be withdrawn through the air-permeable conveyor. Commonly owned U.S. Pat. No. 4,175,570, granted Nov. 27, 1979 to Uwe Heitmann, discloses the provision of suction ports in one sidewall of the distributor in a cigarette rod making machine and the placing of a suction chamber at the outer side of the one sidewall so that the surplus of air can be evacuated from the channel and the remainder of air can be withdrawn through the pores, interstices or otherwise configurated openings of the tobacco transporting conveyor. A drawback of the patented apparatus is that the rate of air flow through the ports of the one sidewall is limited and also that the pores are likely to be clogged with tobacco particles because they are immediately adjacent to the trajectories of such particles on their way toward the tobacco transporting conveyor. This can create serious problems and long-lasting interruptions in the operation of a rod making machine. Since a cigarette rod making machine can turn out in excess of 8000 plain cigarettes per minute, even short-lasting interruptions in the operation of such machines entail tremendous losses in output. The situation is aggravated whenever the channel is partially or completely clogged with tobacco particles because this almost invariably entails at least some clogging of suction ports in the patented apparatus.

OBJECTS AND SUMMARY OF THE INVENTION

An object of the invention is to provide a novel and improved apparatus for the formation of a continuous tobacco stream wherein the clogging of openings which permit evacuation of surplus air from the channel at the tobacco-receiving side of the tobacco transporting conveyor is avoided with a much higher degree of reliability and predictability than in heretofore known apparatus.

Another object of the invention is to provide an apparatus of the above outlined character which allows relatively large quantities of air to act upon tobacco particles nearly all the way to the respective side of the tobacco transporting conveyor but is nevertheless capable of reliably evacuating the surplus of air by a route other than through the tobacco transporting conveyor.

A further object of the invention is to provide an apparatus wherein the surplus of air can be evacuated from the channel in such a way that the evacuation of surplus does not influence the trajectories of tobacco particles on their way toward the tobacco transporting conveyor.

An additional object of the invention is to provide an apparatus which can be installed in existing cigarette rod making or analogous machines as a superior substitute for heretofore known tobacco stream forming apparatus.

Still another object of the invention is to provide a novel and improved method of segregating surplus air from the mass of tobacco particles which are in the process of advancing toward the respective side of an air-permeable tobacco transporting conveyor in the distributor of a cigarette rod making machine.

A further object of the invention is to provide the apparatus with novel and improved sidewalls which flank the channel at one side of the tobacco transporting conveyor in a cigarette rod making or like machine.

An additional object of the invention is to provide the apparatus with novel and improved means for preventing the obstruction of tobacco particles during the last stage of their travel toward the stream building zone of the distributor in a rod making machine.

The invention is embodied in an apparatus for forming a continuous tobacco stream in the distributor of a filler forming machine, e.g., in the distributor of a cigarette rod making machine. The apparatus comprises a conveyor including an air-permeable tobacco advancing element which is driven to move in a predetermined direction, suction generating means adjacent to the first side of the air-permeable element, first and second sidewalls adjacent to the second side of and defining with the air-permeable element an elongated channel extending in the predetermined direction, a downwardly sloping duct or another suitable source of tobacco particles, a source of compressed air, and means for feeding tobacco particles to the conveyor. The feeding means comprises means for supplying particles of tobacco from the respective source into the channel so that the particles advance toward the second side of the air-permeable element of the conveyor and adhere to the second side under the action of the suction generating means, and means for admitting compressed air from the respective source to the particles of tobacco which are about to enter the channel in such quantities that the channel receives more air than can or should be evacuated therefrom through the air-permeable element of the conveyor. In accordance with a feature of the invention, at least one of the sidewalls has an air-permeable portion or section for evacuation of surplus air from the channel. Such air-permeable portion is recessed in a direction away from the other sidewall and defines at least one edge face beyond which the particles of tobacco advance from the tobacco supplying means toward the second side of the air-permeable element. The suction generating means preferably comprises a suction chamber which communicates with the channel by way of the air-permeable element of the conveyor and means (e.g., a blower) for drawing air from the suction chamber.

If the quantity of surplus air in the channel is quite pronounced, each of the sidewalls can comprise an air-permeable portion for evacuation of a certain percentage of surplus air from the channel. The tobacco supplying means extends to the edge face which is defined by the one sidewall.

The apparatus preferably further comprises means for drawing air from the channel by way of the air-permeable portion or portions of the one sidewall or both sidewalls. Each such air drawing means can comprise a suction chamber which is outwardly adjacent to the respective air-permeable portion and means (e.g., a blower) for evacuating air from the suction chamber.

The tobacco supplying means can comprise an arcuate guide wall terminating at the edge face of the air-permeable portion of the one sidewall, and such guide wall is preferably formed with a concave side or surface along which the particles of tobacco advance from the respective source toward the edge face of the air-permeable portion of the one sidewall. The means for admitting compressed air preferably comprises a nozzle which receives compressed air from the respective source and serves to admit streams or jets of compressed air to the tobacco supplying means, preferably to the inlet portion of the arcuate path which is defined by the aforementioned guide wall. The latter terminates at the edge face of the air-permeable portion of the one sidewall and defines an arcuate path receiving tobacco particles from the respective source and streams of compressed air from the nozzle. The guide wall is preferably formed with a plurality of staggered guide faces which terminate at the edge face of the air-permeable portion of the one sidewall and serve to direct partial streams of tobacco particles against selected portions of the second side of the air-permeable element of the conveyor. The arrangement is preferably such that the guide faces include a first guide face serving to direct a first partial stream of tobacco particles against a first portion of the second side of the air-permeable element adjacent to the one sidewall, a second guide face serving to direct a second partial stream of tobacco particles against a second portion of the second side of the air-permeable element which is adjacent to the other sidewall, and a third guide face which serves to direct a third partial tobacco stream against a third (central) portion of the second side of the air-permeable element between the first and second portions of the second side. The three portions of the second side of the air-permeable element are preferably staggered with reference to each other, as considered in the predetermined direction. The edge face of the air-permeable portion of the one sidewall is preferably a composite edge face including a discrete edge face for each of the guide faces, and all such edge faces can be disposed in a common horizontal plane.

The conveyor can comprise an endless air-permeable band conveyor having an elongated reach which constitutes the air-permeable element, or a rotary disc-shaped conveyor having an air-permeable circumferential wall which constitutes the air-permeable element.

The arcuate guide wall of the tobacco supplying means can merge into the one sidewall or defines therewith a gap which allows for escape of surplus air from the channel.

The sidewalls can be disposed in substantially vertical planes.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged vertical sectional view of a detail in the distributor of FIG. 1, showing the means for feeding tobacco particles into the channel adjacent to the air-permeable element of the tobacco stream forming and transporting conveyor;

FIG. 3*a* is an enlarged fragmentary transverse vertical sectional view as seen in the direction of arrows from the line III*a*—III*a* of FIG. 2;

FIG. 3*b* is an enlarged fragmentary elevational view as seen in the direction of arrows from the line III-*b*—III*b* of FIG. 2;

FIG. 4 is a fragmentary vertical sectional view similar to that of FIG. 2 but showing a portion of a modified distributor;

FIG. 6 is a fragmentary transverse vertical sectional view as seen in the direction of arrows from the line VI—VI of FIG. 5*a;*

DESCRIPTION OF THE PREFERRED EMBODIMENTS

Figure 1:
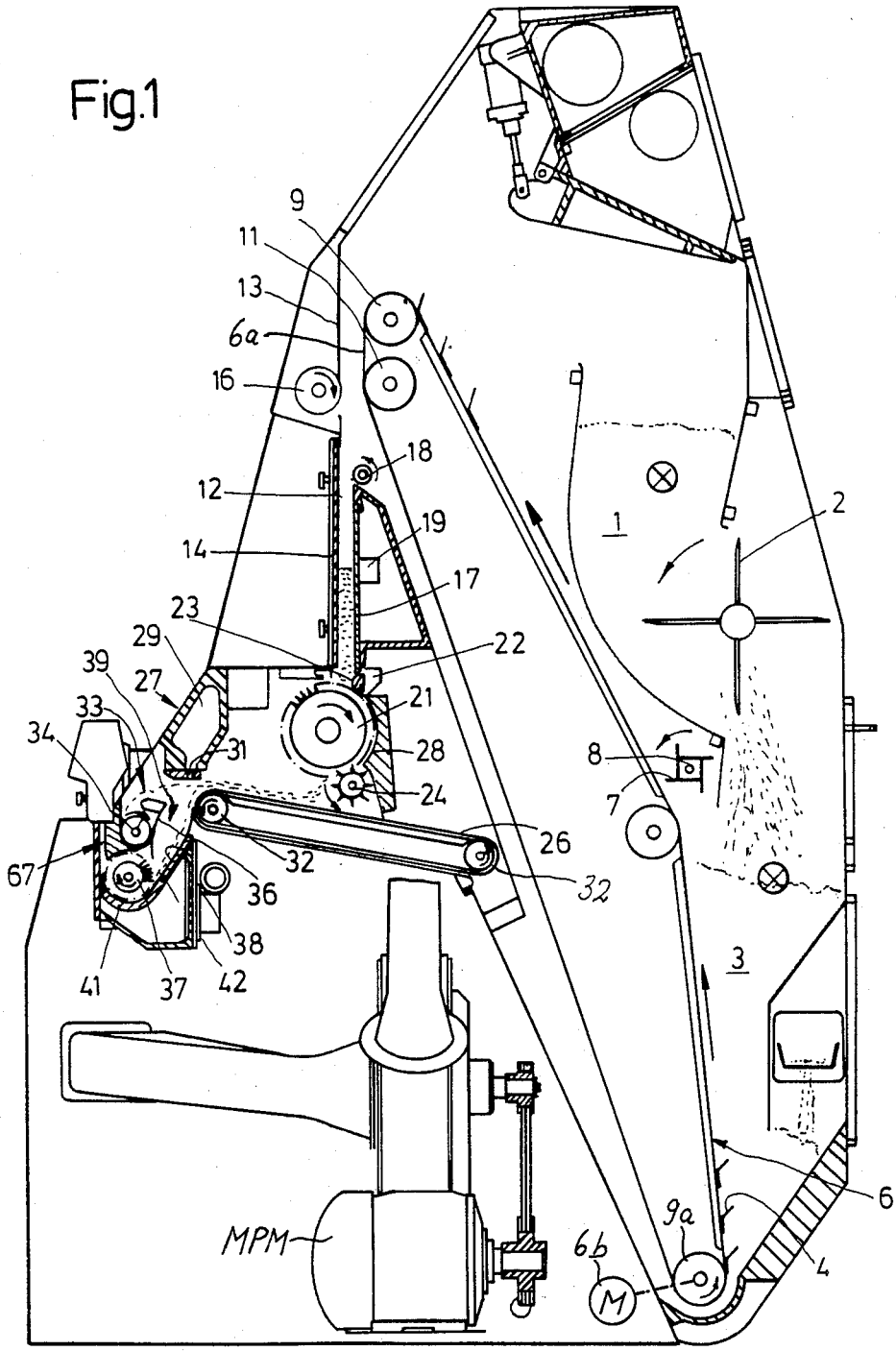
FIG. 1 is a side elevational view of a distributor which forms part of a cigarette rod making machine and embodies one form of the invention, the front sidewall of the frame of the cigarette rod making machine being omitted and certain parts being shown in a vertical sectional view.

FIG. 1 shows a distributor which comprises a main magazine 1 containing a rather substantial supply of tobacco particles (normally including mainly tobacco shreds, some short tobacco, some fragments of tobacco ribs and possibly a few pieces of metal). A rotary rake 2 is provided to transfer tobacco from the main magazine 1 into a smaller second magazine 3 which has an open side adjacent to the upwardly moving reach of a steep endless belt conveyor 6. The conveyor 6 has equidistant external entraining elements 4 which define pockets serving to draw batches of tobacco particles from the supply in the second magazine 3, and each such batch is equalized by a driven paddle wheel 8 having flexible vanes or paddles 7 (e.g., in the form of leather straps) which brush off the surplus from successive batches while the entraining elements 4 advance toward a pulley 9 at the upper end of the conveyor 6. The pulley 9 is rather closely adjacent to and is disposed at a level above a deflecting roller 11 which ensures that the uppermost portion 6*a* of the left-hand reach of the conveyor 6 is vertical or nearly vertical, namely, that the portion 6*a* is at least substantially parallel to an upright guide wall 13 constituting an upward extension of the left-hand or front sidewall 14 of an upright duct 12. The guide wall 13 has an opening for a portion of a driven magnetic roller 16 serving to attract particles of metallic material, if any, which might be present in the batches of tobacco that are dumped by successive entraining elements 4 subsequent to travel around the pulley 9. The top portion of the right-hand or rear sidewall 17 of the duct 12 carries a driven roller 18 which is rotated at a constant speed and prevents shreds or other particles of tobacco from accumulating on top of the sidewall 17. The portion 6*a* of the left-hand reach of the conveyor 6 cooperates with the guide wall 13 and with the driven roller 18 to ensure that all particles of tobacco which are dumped by successive entraining elements 4 find their way into the duct 12.

The rear sidewall 17 of the duct 12 carries a monitoring device 19 which preferably includes a battery of reflection type photocells (not specifically shown). The photocells are staggered, as considered in as well as at right angles to the plane of FIG. 1, and generate signals denoting the levels of the corresponding portions of the column of tobacco particles in the duct 12. The photocells are electrically connected to each other and transmit signals when they are disposed at levels below the adjacent portions of the tobacco column in the duct 12 for preselected intervals of time. The signals are transmitted via suitable time-delay elements and serve to control the operation of a variable-speed motor 6*b* for the lower pulley 9*a* of the conveyor 6. This ensures that the level of the top surface of the column of tobacco particles in the duct 12 is constant or fluctuates only slightly within a rather narrow range. Reference may be had, for example, to commonly owned U.S. Pat. No. 4,223,845 granted Sept. 23, 1980 to Fritz Selonke et al. and particularly to commonly owned U.S. Pat. No. 4,235,248 granted Nov. 25, 1980 to Peter Schumacher.

The discharge end of the duct 12 is located at the one o'clock position of a rotary carded conveyor in the form of a drum 21 which is driven at a variable speed by the main prime mover MPM of the rod making machine through the medium of a suitable transmission, not shown. The carding of the drum 21 is filled with tobacco particles during travel below the open lower end of the duct 21, and the uniformity of such filling is enhanced by a reciprocable homogenizing element 22 which is installed below the lower end portion of the sidewall 17 and has a profiled projection 23 extending into the pile of tobacco particles in the lower portion of the duct 12. The manner in which the homogenizing element 22 can enhance the penetration of tobacco particles into and uniform distribution of such particles in the carding of the drum 21 is fully disclosed in commonly owned U.S. Pat. Nos. 3,996,943 and 3,996,944 granted Dec. 14, 1976 to Alfred Hinzmann. The homogenizing element 22 is a bar or strip which is caused to oscillate in directions substantially at right angles to the plane of FIG. 1 and at a frequency which varies with the speed of the carded drum 21.

A rapidly driven rotary picker roller 24 is adjacent to the carding at the five o'clock position of the drum 21 and serves to expel the particles of tobacco from the carding so that the expelled particles accumulate on the upper reach of an upwardly sloping endless apron conveyor 26 and form thereon a layer or carpet which is transported toward, and successive increments of which are propelled into, a classifying device 27. The directions in which the carded drum 21 and the picker roller 24 rotate are indicated by arrows. The picker roller 24 is driven at a constant speed and is partially surrounded by a stationary shroud 28 which further partially surrounds the drum 21 and extends from the homogenizing element 22 all the way to the upper reach of the apron conveyor 26. The purpose of the shroud 28 is to prevent escape of tobacco particles from the carding of the drum 21 on their way from the outlet of the duct 12 toward the picker roller 24 as well as to prevent propulsion of tobacco particles (by the needles or pins of the picker roller 24) in a direction to the right, as viewed in FIG. 1, and beyond the rear end portion of the upper reach of the apron conveyor 26. The front pulley 32 for the apron conveyor 26 is driven at a constant speed by a suitable motor, not shown, e.g., by the motor which also drives the picker roller 24. The external surface of the apron conveyor 26 is preferably profiled and preferably constitutes the exposed side of a layer consisting of rubber or another elastomeric material which is capable of enhancing friction so as to ensure that tobacco particles which form the aforementioned carpet advance toward the left-hand pulley 32 at least substantially without slippage.

The classifying device 27 comprises a plenum chamber 29 having a bottom portion provided with a horizontal row of square or rectangular openings 31 serving to direct jets of compressed air downwardly in front of the apron conveyor 26. Such jets form a curtain which can deflect lightweight particles of tobacco but does not appreciably influence (alter) the trajectories of heavier particles which thus traverse the curtain and accumulate in a collecting receptacle 33. The bottom portion of the receptacle 33 surrounds a rotary feed screw 34 which serves to evacuate the heavier particles (particularly fragments of tobacco ribs) from the classifying device 27, either continuously or at regular or irregular intervals. The openings 31 are closely adjacent to each other so that the curtain of air is practically uninterrupted and thus reduces the likelihood of propulsion of satisfactory tobacco particles into the receptacle 33. The classifying device 27 further comprises a vertically adjustable barrier 36 which can be moved to any one of a number of different levels to select the quantity and weight of particles which are permitted to enter the receptacle 33. Thus, if the barrier 36 is moved to a higher level, the particles which are partially deflected by the air curtain are prevented from entering the receptacle 33 because they impinge upon the concave right-hand side of the barrier. Inversely, when the barrier 36 is moved to a lower level, it allows the heaviest as well as less heavy particles to enter the receptacle 33. The concave right-hand side of the barrier 36 directs the intercepted particles of tobacco (especially shreds) downwardly and into a duct 39 which gathers a tobacco stream 42 (see also FIG. 2) that slides along the inner side of a downwardly sloping wall 38. The latter causes successive increments of the stream 42 to enter the range of radially outwardly extending pins or needles at the periphery of a rotary carded conveyor 37 which is driven in a clockwise direction, as viewed in FIG. 1 or 2, and at a constant speed by a suitable prime mover, e.g., the aforementioned prime mover which drives the picker roller 24 and the apron conveyor 26. The duct 39 is defined by the barrier 36, by the wall 38 and by the carded conveyor 37, and the purpose of this duct is to receive and control the direction of advancement of all tobacco particles which are incapable of penetrating the air curtain and entering the receptacle 33 of the classifying device 27.

The lower portion of the wall 38 overlies a portion of an arcuate guide wall 41 whose concave upper side faces the adjacent lower portion of the carded conveyor 37 and which constitutes a means for supplying tobacco particles into an elongated tobacco channel 67. The concave side of the guide wall 41 is spaced apart from the tips of adjacent pins of the carded conveyor 37 to provide room for advancement of tobacco particles toward and into the lower portion of the channel 67 as well as for influencing of such particles during travel from the inlet toward the outlet of the arcuate path which is defined by the guide wall 41. The curvature of the concave upper side of the guide wall 41 preferably equals or approximates the curvature of the periphery of the carded conveyor 37.

The inlet of the arcuate path which is defined by the guide wall 41 (namely, the region where successive increments of a stream 42 of tobacco particles leave the wall 38 and duct 39 and descend onto the wall 41) is adjacent to an air admitting device which serves to admit several streams of compressed air (note the arrow 43) into the funnel-shaped gap between the rearmost portion 47 of the guide wall 41 and the lowermost portion 53 of the wall 38. Compressed air issues from a plenum chamber 46 which is connected to the pressure side of a blower 44. The reference character 48 denotes in FIG. 2 one of several partitions which are provided at the concave inner side of the guide wall 41 and serve to impart to the respective air streams a component of movement in the direction (arrow 49 in FIG. 3*a*) of advancement of the lower reach (air-permeable element) of an endless band-like tobacco stream transporting conveyor 51. The lower reach of the conveyor 51 constitutes the upper boundary of the aforementioned tobacco channel 67 which is flanked by two spaced-apart parallel upright sidewalls 64 and 66 of the distributor. The channel 67 is disposed at a level below the lower reach of the conveyor 51, and the upper side of such lower reach is adjacent to a stationary suction chamber 76 having a bottom wall 73 with openings 72 which permit air to flow from the channel 67 into the suction chamber 76.

The partitions or vanes 48 at the concave side of the guide wall 41 are elongated ribs (see FIG. 3*b*) which define between themselves a plurality of relatively narrow passages 52 for the flow of streams of compressed air from the plenum chamber 46 into the arcuate path at the concave side of the guide wall 41 below the carded conveyor 37. The direction of flow of such streams of compressed air is indicated by arrows 84, and it will be noted that each air stream has a component of movement in the direction (arrow 49) in which the underside of the lower reach of the conveyor 51 advances the growing and the fully grown tobacco stream within and from the channel 67.

The lowermost portion 53 of the downwardly sloping wall 38 of the duct 39 constitutes a cover which is spaced apart from and overlies the passages 52 between the partitions 48 of the guide wall 41, and the concave upper side of the cover 53 guides successive increments of the tobacco stream 42 into the streams of compressed air flowing in and beyond the passages 52. The parts 47, 48 and 53 can be said to constitute an air admitting nozzle 55 whose interior is subdivided into the aforementioned passages 52 by the partitions 48 and which directs the streams of compressed air in the directions indicated by the arrows 84 to thereby control the acceleration as well as the direction of movement of tobacco particles which form the stream 42 and enter the space between the lower portion of the carded conveyor 37 and the non-overlapped portion of the arcuate guide wall 41.

The outlet of the path which is defined by the concave upper side of the guide wall 41 terminates at a composite horizontal edge face including three discrete edge faces 58, 59, 61 defined by an air-permeable portion or section 64' of the sidewall 64. Such discrete edge faces are spaced apart from the underside of the lower reach of the conveyor 51 and are staggered with reference to each other, as considered transversely of the direction which is indicated by the arrow 49. The edge faces 58, 59, 61 are respectively disposed at the discharge ends of three guide faces 54, 56, 57 which are defined by the outlet portion of the guide wall 41 at a level below the channel 67 and along which three discrete partial streams 81, 82,83 of tobacco particles advance in the directions indicated by the arrows 84, i.e., each with a component of movement in the direction of arrow 49. Tobacco particles and streams of compressed air which flow along the guide faces 54, 56, 57 are caused to advance beyond the respective edge faces 58, 59, 61 and toward the underside of the lower reach of the conveyor 51. The orientation of the guide faces 54, 56, 57 with reference to the underside of the lower reach of the conveyor 51 is such that imaginary lines extending therealong and being tangential to the guide wall 41 point toward different portions of the underside of the aforementioned lower reach. Thus, the guide face 54 of the guide wall 41 directs the partial stream 81 of tobacco particles against the left-hand marginal portion of the lower reach of the conveyor 51, as viewed in FIG. 2 (close to the sidewall 64), the guide face 57 directs the partial stream 82 of tobacco particles against the right-hand marginal portion of the underside of the lower reach (close to the sidewall 66), and the guide face 56 directs the partial stream 83 of tobacco particles against the median or central portion of the underside of the lower reach of the conveyor 51. In the embodiment of FIG. 2, the guide faces 54, 56, 57 are flat or substantially flat and the edge faces 58, 59, 61 are equidistant from the underside of the lower reach of the conveyor 51.

The guide faces 54, 56 are separated from each other by an additional surface 62 of the guide wall 41, and the guide faces 56, 57 are separated from one another by an additional surface 63. The inclination of additional surfaces 62 and 63 is the same as that of the air streams which carry the particles of tobacco into the channel 67, i.e., beyond the edge faces 58, 59 and 61. Such inclination of the additional surfaces 62, 63 ensures that the partial tobacco streams 81, 82 and 83, which are propelled beyond the respective edge faces 58, 61, 59 of the air-permeable portion 64' of the sidewall 64, cannot interfere with each other during travel in the channel 67 and toward the lower reach of the conveyor 51.

The air-permeable portion or section 64' slopes downwardly and outwardly in a direction away from the other sidewall 66 and has openings 68 which establish communication between the channel 67 and a suction chamber 69 which is outwardly adjacent to the portion 64' of the sidewall 64 and is connected to the suction intake of a blower 71. The portion 64' merges into the lowermost portion of the sidewall 64 at the general level of the edge faces 58, 59, 61 and the lower portion of the sidewall 64 merges gradually into the guide wall 41. The lower part of the air-permeable portion 64' defines a pronounced ledge at the level of the edge faces 58, 59, 61 and the openings 68 are spaced apart from the nearest partial stream 81 of tobacco particles. Such configuration of the air-permeable portion 64' ensures that the suction chamber 69 can draw some (surplus) air from the channel 67 but that the streams of air passing through the openings 68 are not likely to entrain particles of tobacco whose inertia should be sufficient to ensure that they remain in the streams 81, 82, 83 and to continue their movement in the channel 67 toward the underside of the lower reach of the conveyor 51. This ensures that the openings 68 are not likely to be clogged with particles of tobacco, i.e., that the suction chamber 69 is free to draw from the channel 67 all such air which is not or cannot be caused to pass through the interstices of the lower reach of the conveyor 51, through the openings 72 in the bottom wall 73 and into the suction chamber 76. The latter is connected to the suction intake of a blower 74.

Figure 8:
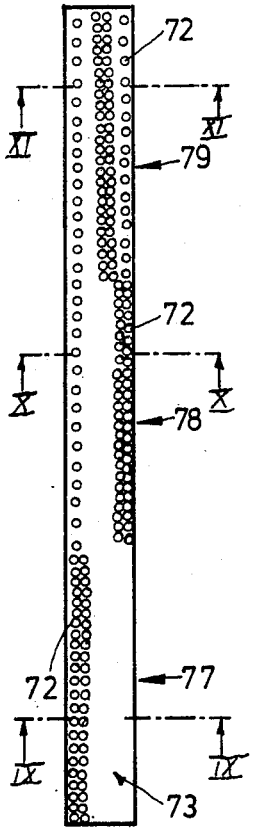
FIG. 8 is a plan view of the bottom wall of a suction chamber in the distributor of FIG. 1, substantially as seen in the direction of arrows from the line VIII—VIII of FIG. 2.

FIG. 8 shows one presently preferred distribution of openings 72 (e.g., circular holes) in the bottom wall 73 of the suction chamber 76. The section 77 of the bottom wall 73 has two rows of openings 72 which are adjacent to the sidewall 64 and serve to attract the particles of the partial stream 81. The next section 78 of the bottom wall 73 (as considered in the direction (arrow 49) of advancement of tobacco particles with the conveyor 51) has two rows of openings 72 adjacent to the sidewall 66 to attract the particles of the partial stream 82 and a single row of openings 72 adjacent to the sidewall 64 to hold the particles of the partial stream 82. The third section 79 of the bottom wall 73 (this section is located downstream of the second section, as considered in the direction of arrow 49) has two centrally located rows of openings 72 to attract the particles of the partial tobacco stream 83 and two additional rows of openings 72 which are adjacent to the sidewalls 64 and 66 and serve to hold the corresponding particles of tobacco (previously the particles of the partial streams 81, 82) at the underside of the lower reach of the conveyor 51. Thus, the partial streams 81, 82, 83 are attracted with greater force to the respective portions or sections of the lower reach of the conveyor 51 while their particles are still in the process of travelling upwardly through the channel 67, and the particles which have come to rest at the underside of the lower reach of the conveyor 51 are attracted with lesser force which should suffice to ensure that the particles share the movement of the conveyor 51 in the direction which is indicated by the arrow 49.

The mode of operation of the distributor which embodies the structure of FIGS. **1, 2, 3*a*, 3*b* and 7 to 11** is as follows:

The entraining elements 4 of the conveyor 6 draw relatively small batches of tobacco particles from the second magazine 3 and the quantity of tobacco in each batch matches or approximates the quantity of tobacco in the preceding batch after a batch advances beyond the paddle wheel 8 whose flexible paddles or vanes 7 remove the surplus and return the removed material into the magazine 3. Successive equalized batches are dumped during travel around the pulley 9 and descend between the portion **6*a* the left-hand reach of the conveyor 6 and the guide wall 13 to enter the duct 12 wherein they form a column of tobacco particles. Any particles of metal which might be present in the dumped equalized batches are extracted by the rotating magnetic roller 16. The device 19 monitors the height of the column of tobacco in the duct 12, and its signals regulate the operation of the motor 6*b* or the lower pulley 9*a* of the conveyor 6 so that the speed of the conveyor 6 increases when the level of the top surface of the tobacco column in the duct 12 descends below an acceptable minimum level but the speed of the conveyor 6 is increased when the level of the top surface of the column of tobacco rises above the maximum acceptable level. The arrangement is or can be such that the motor 6*b* varies the speed of the conveyor 6** in stepwise fashion.

The rotating carded drum 21 draws particles of tobacco from the lower end of the duct 12 and its carding is uniformly filled with tobacco particles by the continuously oscillating homogenizing element 22. At the same time, the upwardly extending profiled projection 23 of the homogenizing element 22 loosens the material in the lower portion of the column of tobacco in the duct 12 to ensure predictable advancement of loosened particles into the range of the carding on the drum 21.

The upper part of the shroud 28 prevents escape of tobacco particles from the carding of the drum 21 on their way from the discharge end of the duct 12 toward the picker roller 24, and the lower part of this shroud prevents the picker roller 24 from propelling particles of tobacco rearwardly and beyond the right-hand pulley 32 for the apron conveyor 26, as viewed in FIG. 1. If desired, that portion of the shroud 28 which is adjacent to the picker roller 24 can constitute or resemble a comb whose prongs alternate with the pins of the picker roller, as considered at right angles to the plane of FIG. 1. The particles of tobacco which are expelled from the carding of the drum 21 by the pins of the picker roller 24 descend onto and form on the continuously running apron conveyor 26 a relatively wide carpet whose increments advance toward and beyond the left-hand pulley 32. As a rule, longer shreds of tobacco are held by the pins of the picker roller 24 somewhat longer than the shorter shreds; this is desirable and advantageous for the classifying action of the device 27. Thus, the longer shreds are deposited on the upper reach of the apron conveyor 26 nearer to the right-hand pulley 32 than the shorter shreds and other particles so that such shorter shreds and other particles come to rest on the longer shreds and the longer shreds do not interfere with propulsion of shorter shreds and other particles beyond the left-hand end turn of the conveyor 26.

The apron conveyor 26 transports the carpet of tobacco particles thereon at a constant speed, and successive increments of such carpet are propelled toward the curtain of air issuing from the openings 31 in the bottom portion of the plenum chamber 29. The inertia of heavier particles (such as fragments of ribs which would be likely to puncture the wrapping material for a tobacco filler) suffices to ensure that the deflection of such particles by the downwardly flowing jets of air, which form the aforementioned curtain below the openings 31, is zero or insufficient to prevent the heavier particles from entering the collecting receptacle 33 and descending into the range of the feed screw 34. The feature that the longer shreds are located in the lower portion of the tobacco carpet on the upper reach of the apron conveyor 26 ensures that the longer shreds cannot interfere with the propulsion of heavier tobacco particles (on top of the shreds) across the curtain of air, and the trajectories of the heavier particles are such that all heavier particles enter the receptacle 33. All other particles of the carpet are deflected by the curtain of air to a greater or lesser extent but sufficiently to descend directly into the duct 39 or to impinge upon the concave right-hand side of the vertically adjustable barrier 36 which causes the impinging particles to slide therealong and to descend into the duct 39, i.e., onto the downwardly sloping upper side of the wall 38 in the region where the plenum chamber 46 admits compressed air into the passages 52 of the nozzle 55. The leader of the tobacco stream 42 on the wall 38 enters the arcuate path at the concave upper side of the guide wall 41 downstream of the cover 53.

Figure 9:
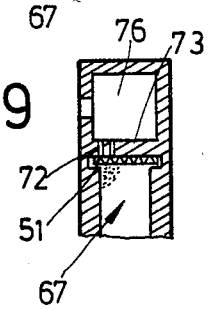
FIG. 9 is a sectional view as seen in the direction of arrows from the line IX—IX of FIG. 8.

The mass of compressed air which flows from the plenum chamber 46 in the direction of arrow 43 enters the passages 52 between the partitions 48 in the interior of the nozzle 55, and such mass of air forms a substantial number of discrete streams which flow in directions indicated by the arrows 84 to meet the particles of tobacco at the downstream end of the cover 53. Each air stream in the nozzle 55 has a component of movement in the direction (arrow 49) of movement of the lower reach of the conveyor 51 above the channel 67. It will be noted that the air streams which are formed in the passages 52 of the nozzle 55 engage the particles of tobacco as soon as such particles enter the arcuate path between the non-overlapped portion of the guide wall 41 and the carded conveyor 37. The particles of tobacco are entrained in the directions indicated by the arrows 84 and form a relatively thin layer which closely hugs the concave upper side of the non-overlapped portion of the guide wall 41 during travel toward the outlet of the arcuate path, namely, toward the edge faces 58, 59 and 61 of the guide wall 41. The aforementioned path contains a mixture of tobacco particles (mainly shreds) and streams of compressed air, and the solid particles of such mixture are subdivided into three partial streams 81, 82, 83 by advancing along the guide faces 54, 56 and 57 of the guide wall 41. The guide face 54 directs successive increments of the partial stream 81 toward the left-hand marginal portion of the underside of the lower reach of the conveyor 51 i.e., toward the two rows of openings 72 in the section 77 of the bottom wall 73 of the suction chamber 76, and such increments of the partial stream 81 are propelled beyond the respective edge face 58 to traverse the channel 67 and to impinge upon the underside of the lower reach of the conveyor 51 in register with the several rows of openings 72 in the section 77 of the bottom wall 73 (see the lower part of FIG. 8 and FIG. 9). Thus, tobacco particles of the partial stream 81 form a first portion of a homogeneous tobacco stream at the underside of the lower reach of the conveyor 51, and such first portion of the homogeneous stream is adjacent to the sidewall 64.

Figure 10:
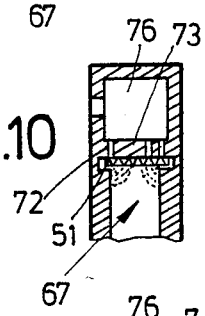
FIG. 10 is a sectional view as seen in the direction of arrows from the line X—X of FIG. 8.

The second partial stream 82 travels along the guide face 56 of the guide wall 41 and is propelled beyond the respective edge face 59 to advance toward and to adhere to the right-hand marginal portion of the underside of the lower reach of the conveyor 51 in the region of the two rows of openings 72 in the section 78 of the bottom wall 73 of the suction chamber 76 (see the median portion of FIG. 8 and FIG. 10). The partial stream 82 thus forms a second part of the growing homogeneous tobacco stream at the underside of the lower reach of the conveyor 51 and downstream of the locus of deposition of tobacco particles of the stream 81, and the first part of the homogeneous tobacco stream (the particles of the partial stream 81) is held against the underside of the lower reach of the conveyor 51 by the single row of openings 72 shown in the left-hand portion of the section 78 of the bottom wall 73.

Figure 11:
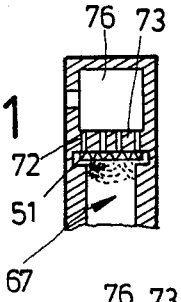
FIG. 11 is a sectional view as seen in the direction of arrows from the line XI—XI of FIG. 8.

The partial stream 83 travels along the guide face 57 and is propelled beyond the edge face 61 to advance toward and to impinge upon the central portion of the underside of the lower reach of the conveyor 51 below the two rows of openings 72 in the section 79 of the bottom wall 73 (see FIGS. 8 and 11). This completes the formation of a homogeneous tobacco stream which overlies the entire underside of the lower reach of the conveyor 51 all the way between the sidewalls 64 and 66. All particles of tobacco which advance beyond the edge faces 58, 59, 61 have a component of movement in the direction of arrow 49 because they advance in the directions which are indicated by the arrows 84. This ensures that the extent of movement of tobacco particles relative to the conveyor 51, upon impingement of such particles on the underside of the lower reach of the conveyor 51, is negligible or nil.

The distribution of openings 72 in a manner as shown in FIGS. 8, 9, 10 and 11 is optional but highly desirable. Thus, the guide faces 54, 56, 57 could suffice to ensure predictable distribution of tobacco particles which form the streams 81, 82 and 83 at the underside of the lower reach of the conveyor 51; however, the distribution of openings 72 in a manner as shown in FIGS. 8 to 11 promotes the formation of a homogeneous tobacco stream which can be converted into a rod-like filler without trimming or with a minimum of trimming. Absence of trimming or a reduction of the extent of trimming entails a reduction of the quantity of short tobacco which develops in the distributor of a cigarette rod making or an analogous machine. The single rows of openings 72 in the sections 78 and 79 of the bottom wall 73 of the suction chamber 76 suffice to ensure adequate retention of the respective portions of the homogeneous tobacco stream on the conveyor 51 during transport of the homogeneous stream toward the trimming station or directly to the wrapping station of the rod making machine. A suitable trimming arrangement for a stream of tobacco particles (except that the stream is disposed at the upper side rather than at the underside of the conveyor) is disclosed in commonly owned U.S. Pat. No. 4,037,608 granted July 26, 1977 to Günter Wahle.

The purpose of the pins on the carded conveyor 37 is to effect further acceleration of tobacco particles which are to form the partial streams 81, 82 and 83. This conveyor constitutes an optional feature of the improved apparatus, i.e., the particles of the stream 42 can be accelerated and caused to change the direction of their travel (to advance in the directions indicated by the arrows 84) exclusively under the action of air streams which are formed in and issue from the nozzle 55.

As a rule, or at least under certain circumstances, the quantity of air which is admitted by the nozzle 55 and flows along the concave upper side of the guide wall 41 toward and into the channel 67 exceeds the quantity of air which can escape through the interstices of the lower reach of the conveyor 51, through the openings 72 of the bottom wall 73 and into the suction chamber 76. The surplus of air which is admitted by the nozzle 55 is withdrawn by the suction chamber 69 via openings 68 in the air-permeable portion 64' of the sidewall 64. As mentioned above, deflection of air which flows in the channel 67 toward the openings 68 is so pronounced that the inertia of ascending tobacco particles in the channel 67 suffices to ensure that such particles remain in the channel 67 and ultimately adhere to the underside of the lower reach of the conveyor 51 rather than to the right-hand side of the air-permeable portion 64', as viewed in FIG. 2. In other words, the trajectories of tobacco particles which form the partial streams 81, 82 and 83 in the channel 67 are not altered by the streams of air which are diverted into the suction chamber 69 by way of the openings 68 in the portion 64'.

An important advantage of the improved apparatus is that the surplus of air can be removed from the channel 67 without adversely influencing the trajectories of tobacco particles which form the partial streams 81, 82 and 83. This is due to the aforediscussed configuration of the air-permeable portion 64' of the sidewall 64, namely, to a configuration which enables the surplus of air to be abruptly deflected in a direction to the left, as viewed in FIG. 2, immediately downstream of the edge faces 58, 59, 61 but without any or without appreciable deflection of tobacco particles which form the adjacent partial stream 81. The particles of the partial streams 81, 82, 83 continue to advance toward selected portions of the underside of the lower reach of the conveyor 51 due to inertia as well as under the action of air which is not deflected by the suction chamber 69 but continues to flow toward the underside of the lower reach of the conveyor 51. The apparatus can be constructed in such a way that the openings 68 of the air-permeable portion 64' of the sidewall 64 serve for evacuation of the major percentage of air that enters the channel 67 along the concave upper side of the guide wall 41. It has beem found that, by the simple expedient of providing the openings 68 in a recessed portion 64' of the sidewall 64, the likelihood of clogging of such openings with tobacco particles is nil or minimal.

The stability of the trajectories of tobacco particles which form the partial streams 81, 82 and 83 is enhanced by the guide faces 54, 56, 57 which cause the respective particles to advance in predetermined directions, namely, not only with a component of movement in the direction of arrow 49 but also in directions toward the respective portions of the underside of the lower reach of the tobacco transporting conveyor 51. Such portions of the underside of this lower reach are staggered with reference to each other, as viewed in the direction of arrow 49, i.e., in the direction of transport of the growing and fully grown tobacco stream at the underside of the lower reach of the conveyor 51. As mentioned above, the streams of air which flow through the passages 52 of the nozzle 55 and the configuration of the guide wall 41 ensure that tobacco particles which leave the source (duct 39) form a relatively thin stream which closely follows the concave upper side of the guide wall 41 and is divided into three partial streams 81, 82, 83 as a result of the provision of guide faces 54, 56, 57 upstream of the edge faces 58, 59, 61. These edge faces can be said to form part of the air-permeable portion 64' of the sidewall 64 or of the discharge end of the guide wall 41. In the embodiment of FIGS. 1, 2, 3*a*, 3*b* and 7 to 11, such edge faces are disposed in a substantially horizontal plane.

Another important advantage of the improved apparatus is that all (or practically all) particles of tobacco which travel (in unsupported condition) in the channel 67 already have a component of movement in the direction of arrow 49 so that they are much more likely to form at the underside of the lower reach of the conveyor 51 a tobacco stream which is homogeneous all the way from the sidewall 64 to the sidewall 66. This is due to the fact that the particles of tobacco which form the stream 42 are subjected to the action of properly oriented air streams as soon as they advance beyond the cover 53 of the nozzle 55, i.e., as soon as they reach the non-overlapped portion of the concave upper side of the guide wall 41. This gives the air streams ample time to adequately influence all particles of tobacco and to form the three partial streams 81, 82 and 83 which are thereupon aimed upon selected portions of the underside of the lower reach of the conveyor 51 to form a tobacco stream of heretofore unmatched homogeneousness. It will be noted that the distance between the cover 53 (i.e., between the nozzle 55) and the outlet (at 57, 58, 59) of the arcuate path which is defined by the guide wall 41 greatly exceeds the distance between the edge faces 58, 59, 61 and the lower reach of the conveyor 51, i.e., the air streams flowing in the directions indicated by the arrows 84 have ample time to adequately influence all particles of tobacco which are about to advance beyond the respective edge faces of the air-permeable portion 64' of the sidewall 64. The feature that the air streams which issue from the nozzle 55 flow along the concave upper side of the guide wall 41 contributes to predictable transport of tobacco particles toward the channel 67 because the air streams closely follow the concave side of the wall 41 so that the gaseous media of such streams effect a very pronounced and desirable stabilization of the travel of tobacco particles in the directions which are indicated by the arrows 84. Subdivision of the interior of the nozzle 55 into several passages 52 by resort to suitably inclined partitions 48 and cover 53 brings about the advantage that the properly oriented streams of compressed air merge into the tobacco stream 42 substantially tangentially and the particles of tobacco are accelerated (in the directions indicated by arrows 84) practically without any turbulence in the region at the concave upper side of the guide wall 41.

The partitions 48 in the nozzle 55 ensure that each of the partial tobacco streams 81, 82, 83 has a component of movement in the direction (arrow 49) of movement of the lower reach of the conveyor 51. The means for imparting to the partial streams 81, 82 and 83 components of movements in directions toward selected portions of the underside of the lower reach of the conveyor 51 (as described in connection with FIGS. 8 to 11) includes the guide faces 54, 56, 57 as well as the additional surfaces 62 (between 54, 56) and 63 (between 56, 57). The number of guide faces at the outlet of the arcuate path for the transport of tobacco particles toward the channel 67 can be reduced to two or increased to four or more. It has been found that the provision of three guide faces (54, 56, 57) normally suffices to ensure adequate distribution of tobacco particles on all such portions of the underside of the lower reach of the conveyor 51 which are hard to reach without any special undertakings. These portions include the marginal portions which are adjacent to the respective sidewalls 64, 66 and the central portion between such marginal portions. As mentioned above, the additional surfaces 62 and 63 render it less likely that the particles of tobacco which form the partial streams 81, 82 and 83 would interfere with each other during travel (in unsupported condition) in the channel 67 and toward the conveyor 51.

It has been found that, by proper selection of the rate of flow of air into the passages 52 of the nozzle 55, by proper selection of the rate of evacuation of air from the channel 67 into the suction chamber 76, and by proper selection of the rate of air flow into the suction chamber 69, the apparatus of the present invention can produce a tobacco stream of heretofore unmatched homogeneousness. This is attributable to the establishment of initial contact between air streams and particles of tobacco well ahead of the conveyor 51 as well as to establishment of adequate contact between the streams of compressed air and all particles of tobacco which form the stream 42. Furthermore, the formation of a highly homogeneous tobacco stream is attributable to the transport of a mixture of tobacco particles and air along the arcuate path which is defined by the guide wall 41 ahead of the channel 67. As mentioned above, the accelerating and direction-determining action of the guide wall 41, in cooperation with the air streams issuing from the nozzle 55, can be so pronounced and so predictable that the carded conveyor 37 can be omitted in its entirety, i.e., the apparatus will operate properly without any mechanical tobacco accelerating means in or downstream of the source (duct 39) from which tobacco is supplied into the range of air streams in the passages 52.

FIG. 4 shows a portion of a modified apparatus wherein all such parts which are identical with or clearly analogous to the corresponding parts of the apparatus of FIGS. 1, 2, 3*a*, 3*b* and 7 to 11 are denoted by similar reference characters plus 100. The main difference between the two embodiments is that the apparatus of FIG. 4 comprises a second suction chamber 169′ which is outwardly adjacent to an outwardly extending air-permeable portion or section 166′ of the right-hand sidewall 166 so that the two suction chambers 169, 169′ can withdraw a larger percentage of air which is supplied by the nozzle (not shown) and enters the lowermost portion of the channel 167 by flowing along the arcuate path which is defined by the concave upper side of the guide wall 141. The rate of air flow through the openings 168 and 168′ of the portions 164′, 166′ can be readily selected in such a way that the flow of some air from the channel 167 into the suction chambers 169, 169′ does not influence the trajectories of particles forming the partial streams 181, 182 and even less the trajectories of particles which form the partial stream 183. The mirror symmetrical arrangement of the air-permeable portions or sections 164′, 166′ contributes to stabilization of the centrally located partial stream 183 as well as to stabilization of the two outer partial streams 181, 182 because surplus air entering the suction chamber 169 is less likely to influence the particles of the partial stream 182 and surplus air entering the suction chamber 169′ is less likely to influence the particles of the partial stream 181. The actions of air streams which flow into the suction chambers 169, 169′ upon the centrally located partial stream 183 of tobacco particles neutralize each other.

An advantage of the apparatus which is shown in FIG. 4 is that the evacuation of surplus air from the channel 167 produces an even more pronounced stabilizing effect upon the trajectories of tobacco particles which form the partial streams 181, 182 and 183. This is due to the fact that the rate of evacuation of surplus air by way of the openings 168′ matches or can at least approximate the rate of evacuation of surplus air by way of the openings 168. Thus, the effect of air streams which leave the channel 167 via openings 168 upon the partial stream 181 is substantially or exactly identical with the effect of air streams which leave the channel 67 via openings 168′ upon the partial stream 182, and the centrally located stream 183 is practically unaffected by the air streams leaving the channel 167 via openings 168, 168′ or the effect of the air streams leaving the channel via openings 168 upon the partial stream 183 is neutralized by the air streams which leave the channel via openings 168′.

Another advantage of the apparatus of FIG. 4 is that it can evacuate very large quantities of surplus air from the channel 167 by a route other than through the lower reach of the conveyor 151.

Figure 5A:
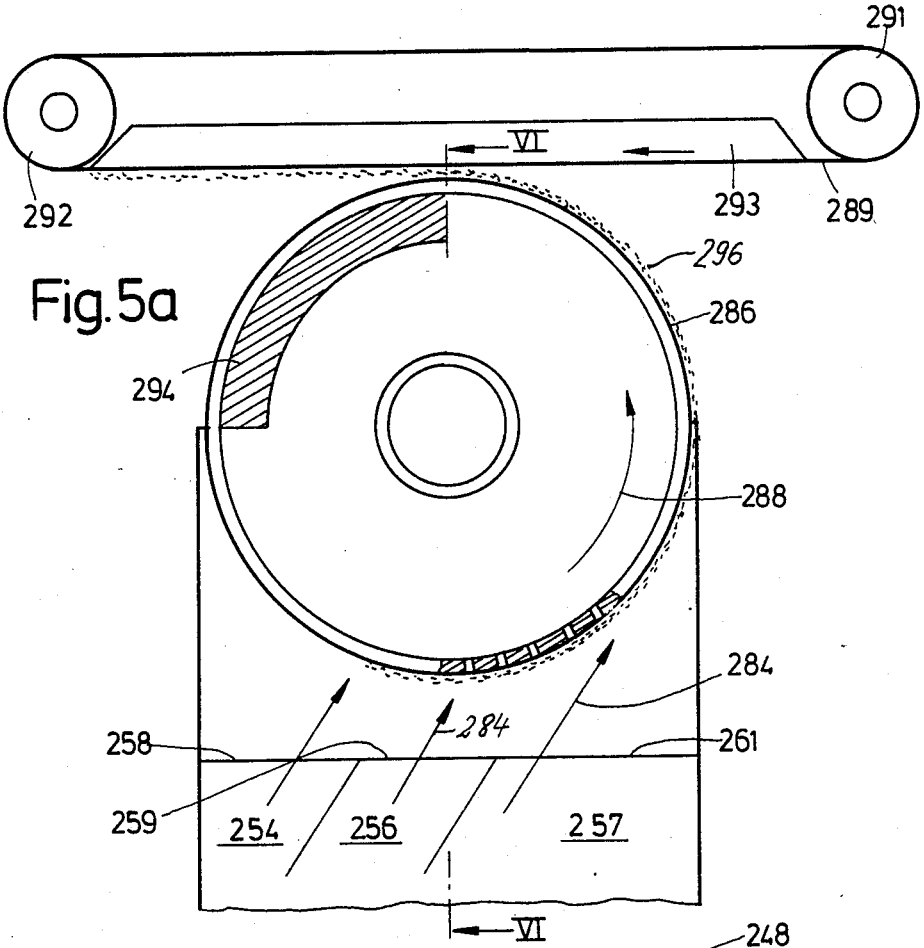
FIG. 5*a* is a fragmentary vertical sectional view of a third distributor wherein the conveyor which receives particles of tobacco to form a homogeneous stream is a disc-shaped rotary member.
Figure 5B:
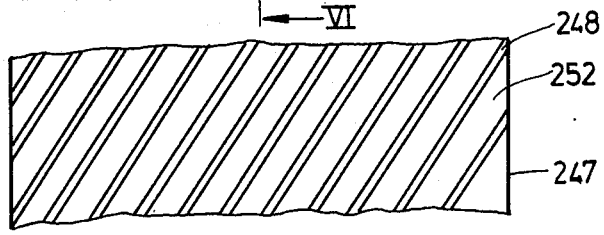
FIG. 5*b* is a view similar to that of FIG. 3*b* but showing a portion of a nozzle for admission of streams of compressed air into a distributor which embodies the structure of FIG. 5*a;*
Figure 7:
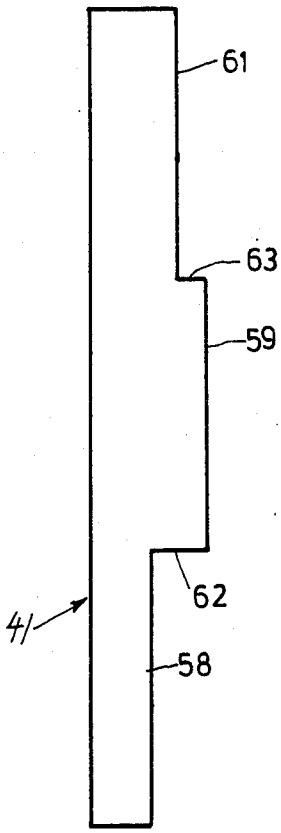
FIG. 7 is a plan view of the tobacco discharging end of tobacco supplying means in the distributor of FIG. 1, substantially as seen in the direction of arrows from the line VII—VII of FIG. 2.

FIGS. 5*a*, 5*b* and 6 illustrate a portion of a third apparatus wherein all such parts which are identical with or clearly analogous to the corresponding parts of the apparatus of FIGS. 1, 2, 3*a*, 3*b* and 7 to 11 are denoted by similar reference characters plus 200. The band-like air-permeable conveyor 51 is replaced with a disc- or wheel-shaped rotary conveyor 286 including an air-permeable circumferentially extending element or wall 273 having radially extending openings 272 communicating with a suction chamber 276 in the interior of the conveyor 286. The channel 287 is a circumferentially complete channel which surrounds the air-permeable element 273 and is flanked by two flanges 264, 266 performing the functions of the aforediscussed sidewalls 64, 66. The guide wall 241 defines an arcuate path for the admission of partial streams 281, 282, 283 of tobacco particles into the channel 287 whereby such partial streams travel first along the guide faces 254, 256, 257 and thereupon beyond the edge faces 258, 259, 261 at the outlet end of the aforementioned arcuate path. The orientation of the guide faces 254, 256, 257 is such that each stream of compressed air flowing along the arcuate path at the concave side of the guide wall 241 flows in the direction which is indicated by arrows 284, i.e., it has a component of movement in the direction of travel of the homogeneous tobacco stream which grows at and thereupon advances with the outer side of the circumferentially extending element 273 of the conveyor 286. The direction of travel of the tobacco stream with the conveyor 286 is indicated by the arrow 288.

The conveyor 286 delivers successive increments of the fully grown homogeneous tobacco stream 296 to the underside of the lower reach of an air-permeable endless belt conveyor 289 which is trained over pulleys 291, 292 and cooperates with a suction chamber 293 having an open or partially open bottom wall adjacent to the upper side of the lower reach of the conveyor 289. A stationary shroud 294 in the interior of the conveyor 286 overlies the inner ends of the openings 272 in the element 273 between the nine and twelve o'clock positions of the conveyor 286, as viewed in FIG. 5*a*, to ensure that the suction chamber 293 can readily attract successive increments of the tobacco stream 296 from the outer side of the element 273 to the underside of the lower reach of the conveyor 289. The surplus of air which the nozzle (not shown) admits into the channel 287 is permitted to escape through a narrow clearance 297 between the flange 264 and the adjacent outwardly extending upper end portion of the guide wall 241. Such upper end portion of the guide wall 241 can be said to form part of or constitute an equivalent of the air-permeable portion 64' or 164' of the sidewall 64 or 164. In other words, the apparatus of FIGS. 5*a*, 5*b* and 6 also comprises means for evacuating the surplus of air from the channel below the conveyor 286 in such a way that the surplus air flowing through the clearance 297 does not adversely influence the trajectories of tobacco particles in the streams 281, 282 and 283.

The annular channel 287 communicates with the channel 267 which is located to the right of the uppermost portion of the guide wall 241, as viewed in FIG. 6; in fact, the annular channel 287 can be said to form part of the channel 267.

FIG. 6 further shows that the guide wall 241 need not cooperate with a carded conveyor, such as the conveyor 37 of FIG. 2.

The fact that the path which is defined by the outer side of the circumferentially extending element 273 of the conveyor 286 is an arcuate (convex) path is of no consequence insofar as the formation of a homogenized tobacco stream is concerned. Thus, the inclination of air streams flowing in the directions indicated by arrows 284 can be readily selected in such a way that the slippage of particles which impinge upon the external surface of the rotating element 273 and/or upon the tobacco particles which are already held at the external surface of such element (while the conveyor rotates in the direction of arrow 288) is nil or negligible. FIG. 5*a* shows that the particles of tobacco which advance in the directions indicated by arrows 284 (especially those advancing beyond the edge face 261) impinge substantially tangentially upon the element 273 so that they are not likely to rebound at the outer side of such element.

The distribution of openings 272 in the element 273 can be readily selected in such a way that the effect is the same as that described in connection with FIGS. 8 to 11. It is also possible to provide the element 273 with uniformly distributed openings 272 and to place at the inner side of the element 273 a stationary valving element (such as a strip having perforations distributed in a manner as shown for the openings 72 in the bottom wall 73 of FIG. 8) which ensures more pronounced and less pronounced attraction of tobacco particles to selected portions of the outer side of the element 273.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for forming a continuous tobacco stream in the distributor of a filler forming machine, comprising a conveyor including an air-permeable tobacco advancing element arranged to move in a predetermined direction and having a first side and a second side; suction generating means adjacent to the first side of said element; first and second sidewalls adjacent to the second side of and defining with said element an elongated channel extending in said direction; a source of tobacco particles; a source of compressed air; and means for feeding tobacco particles to said conveyor, comprising means for supplying particles of tobacco from the respective source into said channel so that the particles advance toward and adhere to the second side of said element under the action of said suction generating means, and means for admitting compressed air from the respective source to the particles of tobacco which are about to enter said channel in such quantities that the channel receives more air than can be evacuated therefrom through said air permeable element, at least one of said sidewalls having an air-permeable portion for evacuation of the surplus of air from said channel, said air-permeable portion being recessed in a direction away from the other of said sidewalls so that it is remote from the nearest trajectories of tobacco particles advancing in said channel toward said element and said one sidewall having a second portion which, together with said air-permeable portion defines at least one edge face beyond which the particles of tobacco advance from said tobacco supplying means toward the second side of said element.

2. The apparatus of claim 1, wherein said suction generating means comprises a suction chamber communicating with said channel by way of said air-permeable element and means for drawing air from said chamber.

3. The apparatus of claim 1, wherein each of said sidewalls comprises an air-permeable portion for evacuation of surplus air from said channel and the air-permeable portion of said other wall is recessed in a direction away from said one sidewall.

4. The apparatus of claim 3, wherein said tobacco supplying means extends to said edge face.

5. The apparatus of claim 1, further comprising means for drawing air from said channel through the air-permeable portion of said one sidewall.

6. The apparatus of claim 5, wherein said means for drawing air comprises a suction chamber outwardly adjacent to said air-permeable portion and means for evacuating air from said chamber.

7. The apparatus of claim 1, wherein said tobacco supplying means comprises an arcuate guide wall terminating at the edge face of said air-permeable portion.

8. The apparatus of claim 7, wherein said guide wall has a concave side along which the particles of tobacco advance from the respective source toward said edge face.

9. The apparatus of claim 1, wherein said admitting means comprises a nozzle receiving compressed air from the respective source and arranged to admit streams of compressed air to said tobacco supplying means.

10. The apparatus of claim 9, wherein said tobacco supplying means comprises an arcuate guide wall terminating at the edge face of said air-permeable portion and defining an arcuate path receiving tobacco particles from the respective source and streams of compressed air from said nozzle.

11. The apparatus of claim 1, wherein said tobacco supplying means comprises a guide wall defining an arcuate path for the transport of tobacco particles from the respective source into said channel, said guide wall having a plurality of guide faces terminating at said edge face and arranged to direct partial tobacco streams against selected portions of the second side of said element.

12. The apparatus of claim 11, wherein said guide faces include a first guide face arranged to direct a first partial tobacco stream against a first portion of said second side which is adjacent to said one sidewall, a second guide face arranged to direct a second partial tobacco stream against a second portion of said second side which is adjacent to said others sidewall, and a third guide face arranged to direct a third partial tobacco stream against a third portion of said second side intermediate said first and second portions.

13. The apparatus of claim 12, wherein said portions of said second side are staggered with reference to each other, as considered in said direction.

14. The apparatus of claim 11, wherein said edge face is a composite edge face including a discrete edge face for each of said guide faces.

15. The apparatus of claim 1, wherein said conveyor comprises an endless air-permeable band having an elongated reach which constitutes said element.

16. The apparatus of claim 1, wherein said conveyor comprises a rotary disc-shaped conveyor having an air-permeable circumferential wall which constitutes said element.

17. The apparatus of claim 1, wherein said edge face is disposed in a substantially horizontal plane.

18. The apparatus of claim 1, wherein said tobacco supplying means comprises an arcuate guide wall merging into said one sidewall.

19. The apparatus of claim 1, wherein said sidewalls are disposed in substantially vertical planes.

20. The apparatus of claim 1, wherein said source of tobacco particles comprises a downwardly sloping duct.

* * * * *